US005595200A

United States Patent [19]

Favaro

[11] Patent Number: 5,595,200

[45] Date of Patent: Jan. 21, 1997

[54] DISHWASHER WITH VERTICALLY ADJUSTABLE BASKET

[75] Inventor: Daniele Favaro, Pramaggiore, Italy

[73] Assignee: Electrolux Zanussi Elettrodomestici S.p.A., Pordenone, Italy

[21] Appl. No.: 500,485

[22] Filed: Jul. 10, 1995

[30] Foreign Application Priority Data

Jul. 15, 1994 [IT] Italy ..... PN940031 U

[51] Int. Cl.[6] ..... A47L 15/50

[52] U.S. Cl. ..... 134/201; 312/310

[58] Field of Search ..... 134/201, 135, 134/164, 165, 200; 312/310, 322, 334.4, 269; 108/102, 137

[56] References Cited

U.S. PATENT DOCUMENTS

| | | | |
|---|---|---|---|
| 3,195,969 | 7/1965 | Wallen | 312/269 |
| 3,321,261 | 5/1967 | Guth | 312/269 |
| 5,115,822 | 5/1992 | Nichols | 134/201 X |
| 5,345,959 | 9/1994 | Matteson | 134/201 |

FOREIGN PATENT DOCUMENTS

| | | |
|---|---|---|
| 3103059 | 8/1982 | Germany . |
| 4228954 | 3/1994 | Germany . |

*Primary Examiner*—Philip R. Coe

*Attorney, Agent, or Firm*—Pearne, Gordon, McCoy & Granger

[57] ABSTRACT

A dishwasher basket (5) slides along horizontal guides to which are attached sliding devices (8) and lateral post-and-slot connectors with two releases (17, 18). The basket (5) can be positioned selectively between an upper position and a lower position, defined by the post-and-slot connectors (17, 18), by applying to the basket a direct upward force so as to activate the connectors.

5 Claims, 3 Drawing Sheets

DISHWASHER WITH VERTICALLY ADJUSTABLE BASKET

BACKGROUND OF THE INVENTION

The present invention refers to a dishwasher, particularly of the household type, with a washing basin accommodating at least one removable basket that is vertically adjustable to support dishes of various sizes.

A dishwasher with an adjustable basket is known, for example from DE 3,103,059, in which the basket slides on horizontal guides. The basket is connected to the guides by means of lateral sliding elements, which must be provided in a minimum quantity of four. The basket is connected eccentrically to the sliding elements. By manual rotation of eccentric elements, the vertical position can be varied selectively between a corresponding upper position and a lower position. Because of the eccentric connection between the basket and the lateral sliding elements, the latter are subject to high bending forces every time the basket is moved horizontally along the guides. Therefore, suitable mechanical locking devices are necessary to maintain the basket securely in the two adjustable positions mentioned above. These locking devices, however, are subject to high loads and make the structure of the machine undesirably complicated. In any case, vertical adjustment of the basket requires an undesirably laborious and uncomfortable manual operation.

From DE 4,228,954, a dishwasher is also known in which the lateral sliding elements are connected to the basket in a vertically sliding manner. The position of the basket can be adjusted to discreet levels defined by several coupling sites made on spring elements of the basket. The coupling sites are engaged selectively by corresponding support indentations in the sliding elements. This solution also turns out to be particularly inconvenient to use, since vertical adjustment of the basket requires separate manual operations of disengaging the spring elements and sliding the basket vertically for each side of the basket.

SUMMARY OF THE INVENTION

The purpose of the present invention is to provide a dishwasher equipped with a basket that can be adjusted vertically in a particularly convenient and rapid manner. The dishwasher is provided with engagement devices that are particularly simple and subject to negligible mechanical loads.

According to the invention, this purpose is achieved in a dishwasher with a vertically adjustable basket incorporating the characteristics described below and in the attached claims.

BRIEF DESCRIPTIONS OF THE DRAWING

The characteristics and advantages of the invention will be understood from the following description, given only by way of non-limiting example, with reference to the attached diagrams, in which:

FIGS. 1 and 2 are schematic side elevational views of a preferred embodiment of the dishwasher, with a basket removed from a washing basin in corresponding lower and upper positions, and FIG. 3 shows schematically a partially enlarged front cross-section of the dishwasher shown in FIG. 2.

DETAILED DESCRIPTION OF THE PREFERRED EMBODIMENTS

Figure 1:
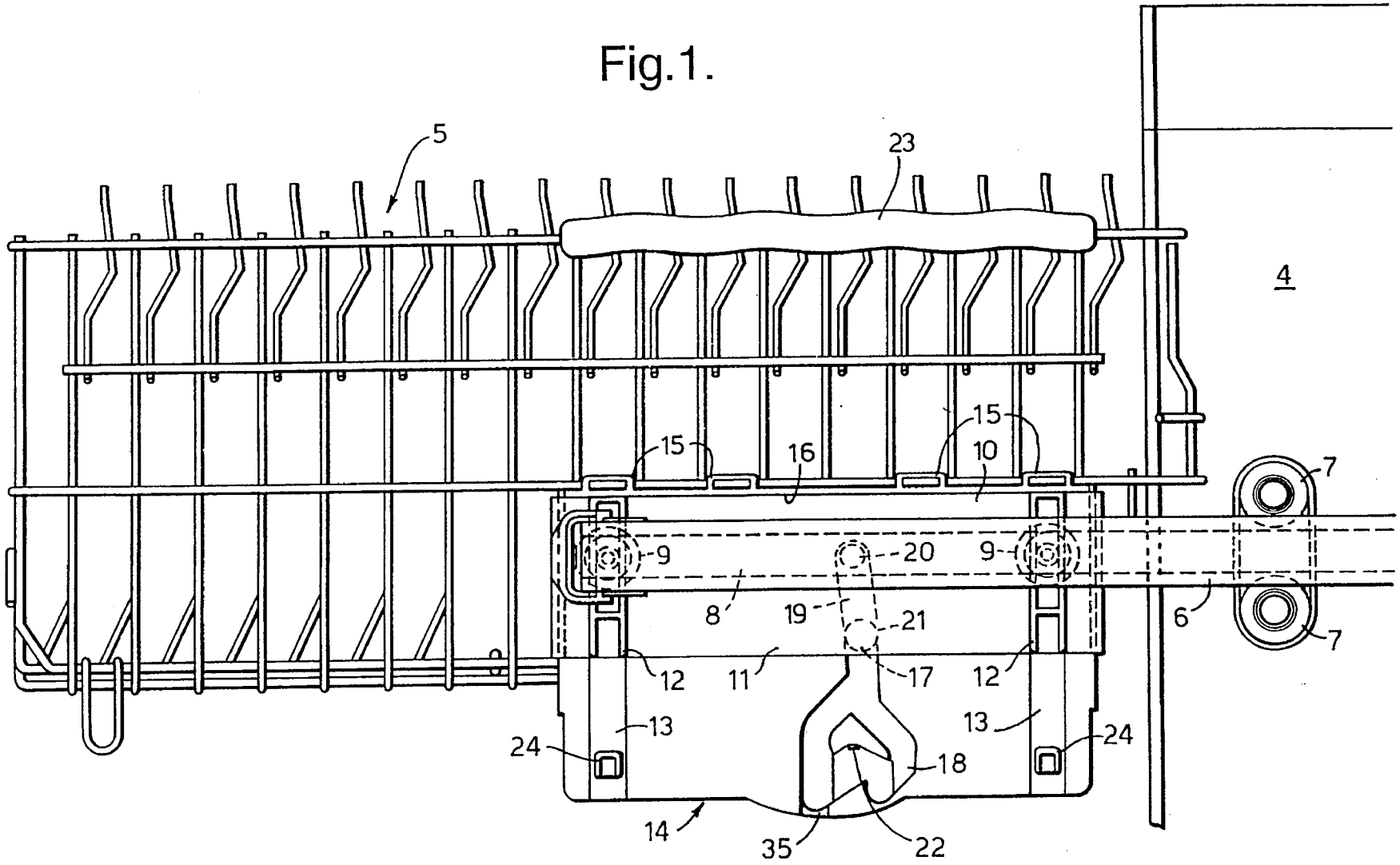
Figure 3:
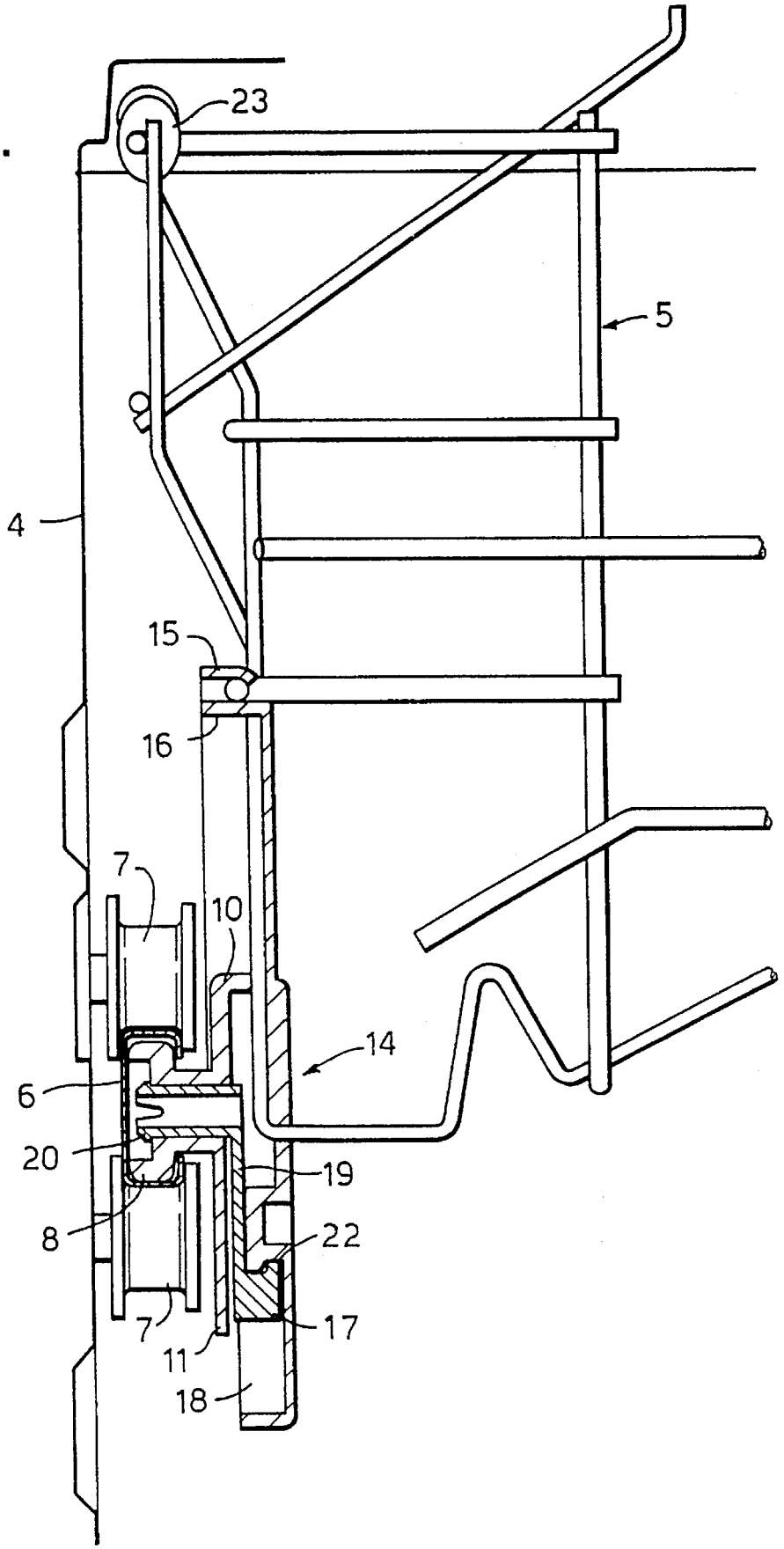

With reference to the figures, a dishwasher comprises a washing basin 4 that accommodates at least one removable basket 5 suitable to support dishes to be washed. Preferably the basin 4 is a plasticized metallic tub. In a known manner, the basket 5 slides horizontally along lateral guides 6 that have essentially C-shaped cross-sections. The guides 6 are mounted so as to slide on rollers 7 journalled on corresponding side walls of the basin. In particular, on both sides, the basket 5 is connected to the guides 6 by means of sliding devices that engage within the guides. Each sliding device comprises, for example, a slider 8 that can be provided with rollers 9. As shown in FIG. 3, the inner face of the slider 8 includes as a unit an upper, rigid flange 10 and a lower, flexible flange 11, so as to form on each side of the basket a substantially rectangular support frame. This frame 10, 11 has on its inner surface, for example corresponding to the rollers 9, vertical ribs 12. The ribs 12 work together in a sliding manner with corresponding vertical grooves 13 of walls 14 that are parts of the basket 5. The walls 14 are preferably realized in plastic, similar to the frame 10, 11 and the slider 8, and can be attached to other parts of the basket 5, by means of indentations for coupling and release 15, or the like. The walls 14 form parts of vertical side walls of the basket. Each wall 14 includes an upper horizontal edge 16, suitable for resting against the upper edge of the flange 10 when the basket 5 is in a lower position, shown in FIG. 1, which is the normal position for use of the basket 5.

Each wall 14 is attached to the adjacent frame 10, 11 and then to the slider 8 by means of reversibly movable post-and-slot connecting devices that include a post 17 and a slot 18 of the so-called "multiple-release" type. In particular, the post 17 can be placed at one end of a lever 19 journalled 20 on the slider 8. The slot 18 is preferably formed on the outer surface of the wall 14. In a known manner, the slot 18 has the shape shown in FIGS. 1 and 2, where the post-slot coupling 17, 18 is of the type with two releases or catches or stops. The post 17 is kept elastically engaged with the slot by the effect of the flange 11. In a known manner, the post 17 can slide freely along the shaped slot 18 in such a way as to be switched in alternation between an upper and a lower position by applying to the wall 14 a direct upward activating force. These upper and lower positions of the post 17 with respect to the slot 18 are defined by respective stopping points 21 and 22 of the slot. Accordingly, each side of the basket 5 can be selectively adjusted in height with respect to the associated slider 8 between a lower position and an upper position, shown respectively in FIGS. 1 and 2. In the lower position of FIG. 1, the post 17 corresponds with the upper stopping point 21 of the slot 18, and the edge 16 of the wall 14 rests on the upper edge of the support flange 10.

Figure 2:
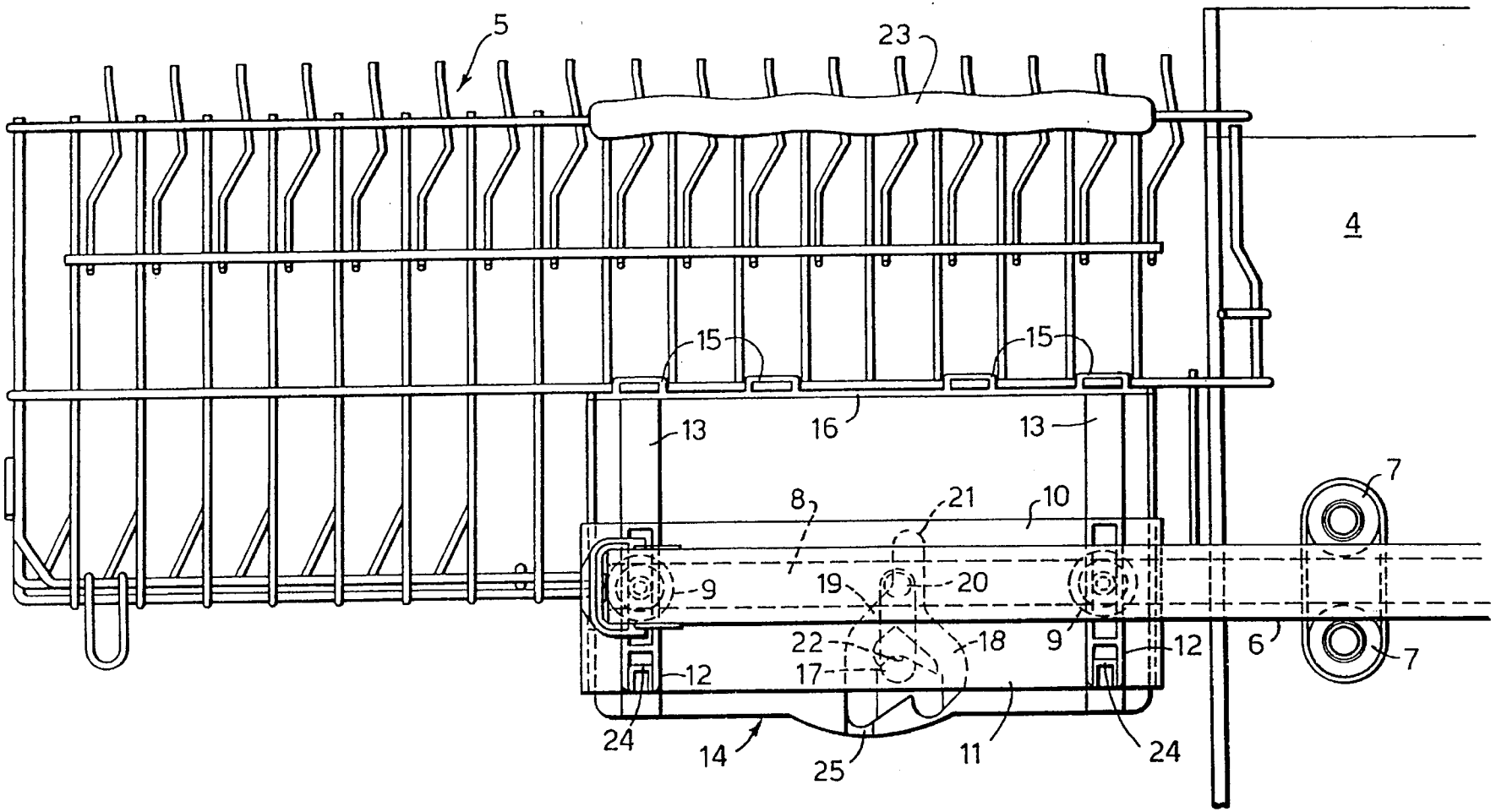

To support one or both sides of the basket 5 in the upper position, it is sufficient to raise the basket, for example by lifting at a handle 23. The wall 14 then rises with respect to the frame 10, 11 and the post 17. The post 17 follows the profile of the slot 18 until it arrives at the lower stopping point 22, as shown in FIGS. 2 and 3. In this position, the post 17 supports the wall 14 and thus the basket 5 by engaging with the stopping point 22 of the slot 18.

To return the basket 5 to the normal lower position, it is sufficient to raise the basket by a short additional distance so as to disengage the post 17 from the stopping point 22 of the slot 18. This temporary raising of the basket 5 is preferably limited by controls 24 formed in the wall 14 and suitable to strike against the sliding devices 8 so as to prevent accidental disengagement of the various components. In particular, this prevents the post 17 from disengaging from the slot 18 through an opening 25 of the slot used for insertion of the post.

After the above-mentioned partial raising, the basket 5 is lowered by gravity with respect to the sliding devices 8 and the post 17. The post 17 follows the profile of the slot 18 until it reaches the upper stopping point 21, returning to the conditions shown in FIG. 1 and described in the preceding.

From what has been described, the constructive simplicity of the dishwasher according to the invention and the particular convenience with which one or both sides of the basket 5 can be selectively adjusted in height with a single simple manual operation of raising, not requiring specific interventions on the part of the user, are evident. Obviously, the dishwasher described can undergo numerous modifications while remaining within the scope of the invention. As has been said, for example, the switchable means of post-and-slot connection 17, 18 can be arranged in various ways so as to permit adjustment of the basket 5 to more than two different vertical positions.

What is claimed is:

1. A dishwasher comprising a washing basin accommodating at least one basket; substantially horizontal side guides along which the basket slides; and sliding devices for connecting the basket to the side guides and adapted for adjustment for selectively varying the vertical position of the basket, characterized by respective post-and-slot connecting devices (17,18) connecting the basket (5) to the sliding devices (8), said connecting devices having at least two releases such that each side of the basket (5) can be selectively positioned between an upper position and a lower position defined by the corresponding post-and-slot devices (17,18) by applying to the basket a direct upward force activating said connecting post-and-slot devices.

2. A dishwasher according to claim 1, characterized by the fact that a slot (18) of the connecting device is part of the basket (5) and a post (17) of the connecting device is part of a lever (19) that is journalled on said sliding device (8), the sliding device being provided with an elastic flange (11) suitable to keep the post in axial contact with the slot.

3. A dishwasher according to claim 1, characterized by a wall (14) laterally attached to the basket (5) by means of coupling devices with releases (15), a slot (18) of the connecting device being formed on the wall (14).

4. A dishwasher according to claim 1, characterized by the fact that in the lower position, the basket (5) rests against the sliding devices (8, 10) by means of striking devices (16).

5. A dishwasher according to claim 1, characterized by the fact that the basket (5) is provided with controls (24) suitable for striking against the sliding devices (8) so as to form a stop for the rising motion of the basket.

* * * * *